US009140529B2

(12) United States Patent
Thuman

(10) Patent No.: US 9,140,529 B2
(45) **Date of Patent: *Sep. 22, 2015**

(54) FIN-STABILIZED PENETRATORS ARRANGED IN A CARRIER SHELL

(71) Applicant: BAE Systems Bofors AB, Karlskoga (SE)

(72) Inventor: Christer Thuman, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 0 days.

This patent is subject to a terminal disclaimer.

(21) Appl. No.: 14/543,980

(22) Filed: Nov. 18, 2014

(65) Prior Publication Data

US 2015/0068424 A1 Mar. 12, 2015

Related U.S. Application Data

(62) Division of application No. 13/635,599, filed as application No. PCT/SE2011/000047 on Mar. 10, 2011, now Pat. No. 8,915,189.

(30) Foreign Application Priority Data

Mar. 18, 2010 (SE) ..... 1000245

(51) Int. Cl.
*F42B 12/58* (2006.01)
*F42B 10/08* (2006.01)
(Continued)

(52) U.S. Cl.
CPC ..... *F42B 12/58* (2013.01); *F42B 10/06* (2013.01); *F42B 12/06* (2013.01); *F42B 12/362* (2013.01); *F42B 12/60* (2013.01); *F42B 10/08* (2013.01); *Y10S 102/703* (2013.01)

(58) Field of Classification Search
CPC ..... F42B 5/02; F42B 5/025; F42B 5/03; F42B 5/035; F42B 5/067; F42B 6/00; F42B 6/003; F42B 8/12; F42B 8/14; F42B 10/02; F42B 10/04; F42B 10/06; F42B 10/08; F42B 10/065; F42B 12/36; F42B 12/58; F42B 12/362; F42B 12/56; F42B 12/60; F42B 12/62; F42B 12/625; F42B 12/64; F42B 12/65; F42B 33/00; F42B 33/001
USPC ..... 102/438, 439, 521, 520, 494, 492, 491, 102/489, 501, 703
See application file for complete search history.

(56) References Cited

U.S. PATENT DOCUMENTS 3,545,383 A * 12/1970 Lucy ..... 102/517
3,673,047 A * 6/1972 Buth et al. ..... 156/563
(Continued)

FOREIGN PATENT DOCUMENTS

FR 621608 A 5/1927
WO WO-0188462 A1 11/2001

*Primary Examiner* — Bret Hayes
*Assistant Examiner* — Derrick Morgan
(74) *Attorney, Agent, or Firm* — Novak Druce Connolly Bove + Quigg LLP

(57) ABSTRACT

The present invention relates to a method for packing fin-stabilized penetrators (8) in a carrier shell (1), which penetrators (8) comprise a front penetrator part (10) and a rear fin part (9, 9') comprising fin sides (14, 14'), so that the empty space between the penetrators (8) and problems with the penetrators upon the release of the penetrators (8) from the carrier shell (1) are minimized, wherein the penetrators (8) are packed in groups (7) and are joined together to form larger packing units (6), in which each group (7) is arranged with a centrally located penetrator (8) flanked by at least three outer penetrators (8), which outer penetrators (8) are arranged so that their front penetrator parts (10) lie side to side against the fin sides (14, 14') of the centrally located penetrator (8). The method is characterized in that the rear fin parts (9, 9') of the penetrators (8) are made shorter than the front penetrator parts (10) of the penetrators (8), and in that the front penetrator parts (10) are made cylindrical for the distribution of load stresses, upon firing of the carrier shell, from the centrally located penetrator (8) rearwards in the direction of firing via the front penetrator parts (10) of, the flanking penetrators (8).

7 Claims, 3 Drawing Sheets

Figure 1:
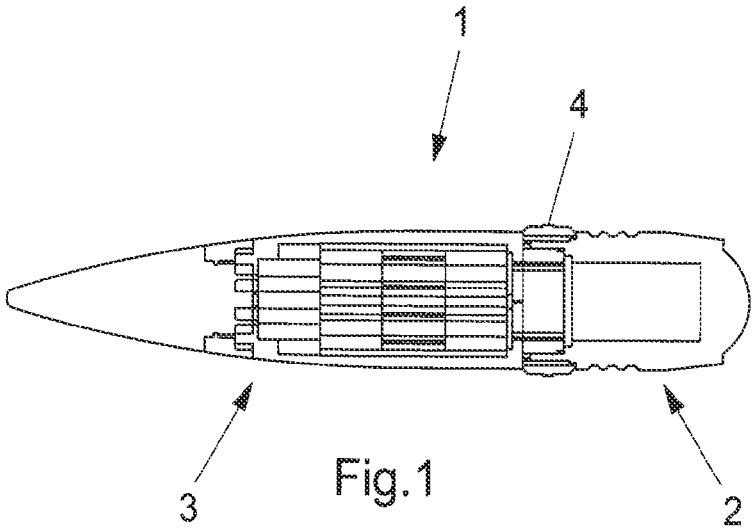

(51) Int. Cl.

| | |
|---|---|
| ***F42B 12/64*** | (2006.01) |
| ***F42B 10/06*** | (2006.01) |
| ***F42B 12/60*** | (2006.01) |
| ***F42B 12/06*** | (2006.01) |
| ***F42B 12/36*** | (2006.01) |

(56) References Cited

U.S. PATENT DOCUMENTS

| | | | | | |
|---|---|---|---|---|---|
| 3,797,359 | A * | 3/1974 | Mawhinney et al. | 89/1.8 |
| 3,941,059 | A * | 3/1976 | Cobb | 102/510 |
| 4,960,055 | A * | 10/1990 | Dieval | 102/489 |
| 5,223,667 | A * | 6/1993 | Anderson | 102/517 |
| 5,515,785 | A * | 5/1996 | Zglenicki | 102/473 |
| 5,796,031 | A * | 8/1998 | Sigler | 102/520 |
| 6,049,957 | A * | 4/2000 | Ettmuller | 86/33 |
| 7,107,910 | B2 * | 9/2006 | Hunn et al. | 102/519 |
| 8,499,694 | B2 * | 8/2013 | Bittle et al. | 102/501 |
| 2006/0048666 | A1 * | 3/2006 | Radchenko | 102/438 |
| 2007/0034073 | A1 * | 2/2007 | Banks | 89/1.815 |
| 2007/0039507 | A1 * | 2/2007 | Hunn et al. | 102/489 |
| 2010/0192796 | A1 * | 8/2010 | Fu | 102/489 |

* cited by examiner

FIN-STABILIZED PENETRATORS ARRANGED IN A CARRIER SHELL

CROSS REFERENCE TO RELATED APPLICATIONS

This application is a Divisional of U.S. patent application Ser. No. 13/635,599 filed on Oct. 25, 2012, which is the National Phase filing under 35 U.S.C. §371 of PCT/SE2011/000047 filed on Mar. 10, 2011; and this application claims priority to Application No. 1000245-9 filed in Sweden on Mar. 18, 2010 under 35 U.S.C. §119. The entire contents of each application are hereby incorporated by reference.

TECHNICAL FIELD

The present invention relates to a method for packing fin-stabilized penetrators in a carrier shell or missile for subsequent release in a combat situation.

The invention is especially intended for packing fin-stabilized projectiles, also referred to as penetrators, in a carrier shell, which penetrators at a later stage, after the shell has been fired from a launcher, are released from the carrier shell for combat against a combatable unit, for example an enemy shell or missile. By combatable unit is also meant air, water or ground vehicles etc., whereby, according to the invention, the penetrators are arranged in a rotationally stable carrier shell or missile in a manner which allows rapid and effective release of the penetrators in combat against the said combatable unit.

Many different, more or less complicated methods for the packing of penetrators have been tried. For example, methods in which the penetrators are packed in a carrier shell by bundling with tape or sleeve joints, wherein the penetrators, after the carrier shell has been fired from a launcher, are released from the carrier shell by the joint being mechanically broken or by the penetrators being able to slide out of the joint.

US 2008/0307994 describes a packing device in which penetrators are packed in a cylindrical combat part in a carrier shell. The cylindrical combat part comprises openable segments arranged around the penetrators. The segments, which are held together with tapes, are opened by breaking of the tapes, whereupon penetrators are released from the combat part.

The tapes are strong enough to hold the segments en place during firing and flight of the carrier shell, but are broken upon activation of a breaking device. Joints which are broken mechanically give rise to problems with the penetrators, which is manifested by variations in speed and direction of the penetrators. In extreme cases, the problems lead to penetrators colliding with one another.

US 2005/0066840 A1 describes a packing method for penetrators whose rear parts, comprising radially protruding fins, are configured with a smaller diameter than the front parts of the penetrators. The smaller diameter allows a denser packing of the penetrators, since the penetrators fill part of the empty spaces between the penetrators. However, the problem with protruding fins on the outer penetrators remains, which means an empty space between the penetrators and the enclosing casing. Different diameters between the front and rear parts of the penetrators also means a more complex construction.

A further problem with the abovementioned packing methods in which the penetrators are packed side by side is the acceleration load which acts upon the fins of the penetrators as the carrier shell is fired, which can lead to problems with the penetrators when released from the carrier shell.

OBJECT OF THE INVENTION AND ITS DISTINGUISHING FEATURES

A main object of the present invention is an improved method for packing fin-stabilized penetrators in a carrier shell, so that the empty space between the penetrators is reduced and so that problems with the penetrators upon their release from the carrier shell are reduced.

The said objects, as well as other objects which are not enumerated here, are satisfactorily met by that which is stated in the present independent patent claims.

Embodiments of the invention are defined in the dependent patent claims.

Thus, according to the present invention, an improved packing method for packing fin-stabilized penetrators in a carrier shell has been provided, which penetrators comprise a front penetrator part and a rear fin part comprising fin sides, so that the empty space between the penetrators and problems with the penetrators upon the release of the penetrators from the carrier shell are minimized.

The packing method is characterized in that the rear fin parts of the penetrators are made shorter than the front penetrator parts of the penetrators, and in that the front penetrator parts are made cylindrical for the distribution of load stresses rearwards, relative to the direction of firing of the carrier shell, from the centrally located penetrator via the front penetrator parts of the flanking penetrators, whereby the fins are wholly relieved of load apart from the bottommost layer of penetrators closest to the rear part of the carrier shell.

According to further aspects of the packing method, according to the invention:

- the front penetrator parts are configured as solid bodies in hard metal,
- the rear fin parts are configured with triangular cross section, corresponding to the tubular shape of the front penetrator parts,
- the rear fin parts are arranged with fastenings for the attachment of flanking penetrators,
- the rear fin parts of the penetrators are configured as separate components for fitting of the front parts of the penetrators,
- the rear fin parts of the penetrators are screwed onto the front parts of the penetrators,
- the rear fin parts of the penetrators are glued onto the front parts of the penetrators.

According to the present invention, a carrier shell comprising fin-stabilized penetrators packed with the said packing method has also been provided.

Advantages and Effects of the Invention

The invention yields a number of advantages and effects.

Configuration of the sides of the fin part so that the shape of the sides corresponds to the shape of the front penetrator part allows an effective dense packing of penetrators, resulting in minimal empty space.

An important effect of the invention is that the loads upon the fins of the penetrators during firing are reduced, which leads to fewer problems with the penetrators upon their release from the carrier shell.

Packing of the front parts of penetrators against the fin part of a centrally located penetrator means that the acceleration load, during firing, travels exclusively via the front penetrator parts, whereby the fins are wholly relieved of load apart from the bottommost layer of penetrators closest to the rear part of the casing, where load is relieved via finless cylinders or via the casing.

The more effective dense packing makes shells of lower weight, volume and cost possible.

Configuration of the fin part of the penetrator as a separate component simplifies the change of fins when damage has occurred.

The fact that the fin part is a separate component which can be stored separately from the penetrator makes the theft of complete penetrators more difficult.

The invention also means greater flexibility, since different fins can be chosen for the penetrator.

The basic concept behind the invention is this a method and a device for packing penetrators in a carrier shell so that the empty space between the penetrators is reduced and so that problems with the penetrators upon their release from the carrier shell are reduced.

The invention has been defined in the following patent claims and shall now be described in somewhat greater detail in connection with the appended figures.

Figure 2:
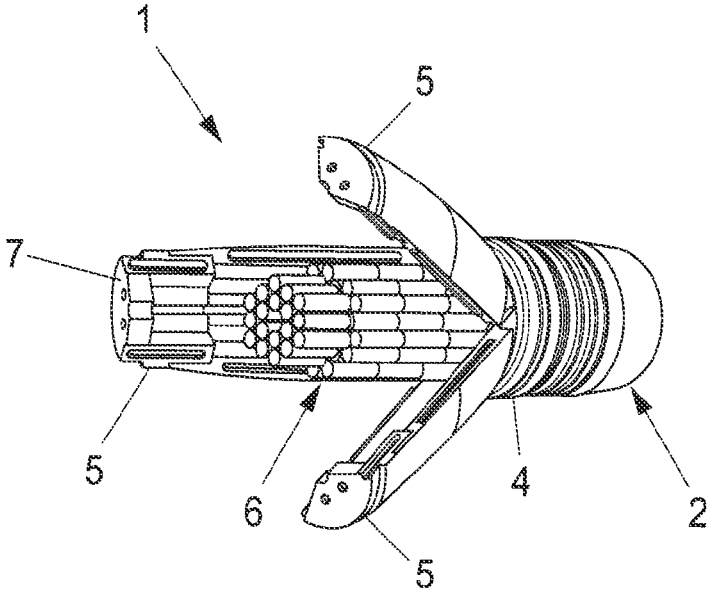
Figure 3:
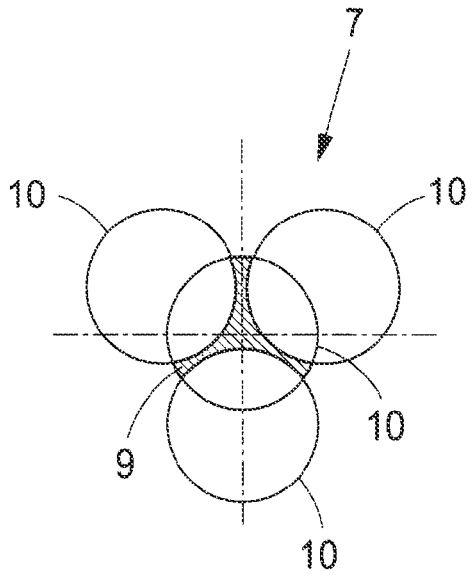
Figure 4:
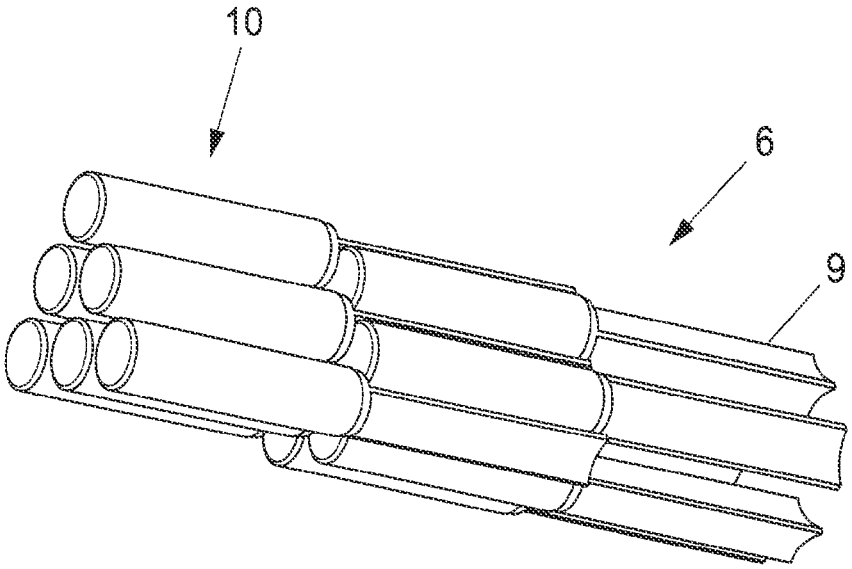

Further advantages and effects will emerge from a study and consideration of the following, detailed description of the invention, with simultaneous reference to the appended figures, in which:

FIG. 1 shows schematically a side view of a carrier shell comprising fin-stabilized penetrators, FIG. 2 shows schematically a side view of a carrier shell according to FIG. 1, viewed obliquely from the front, after the shell has opened for release of the penetrators, FIG. 3 shows schematically a cross section of a group of penetrators comprising a centrally located penetrator flanked by three outer penetrators, which outer penetrators are packed against the fin sides of the centrally located penetrator, FIG. 4 shows schematically a larger packing unit of penetrators according to FIG. 3.

Figure 5:
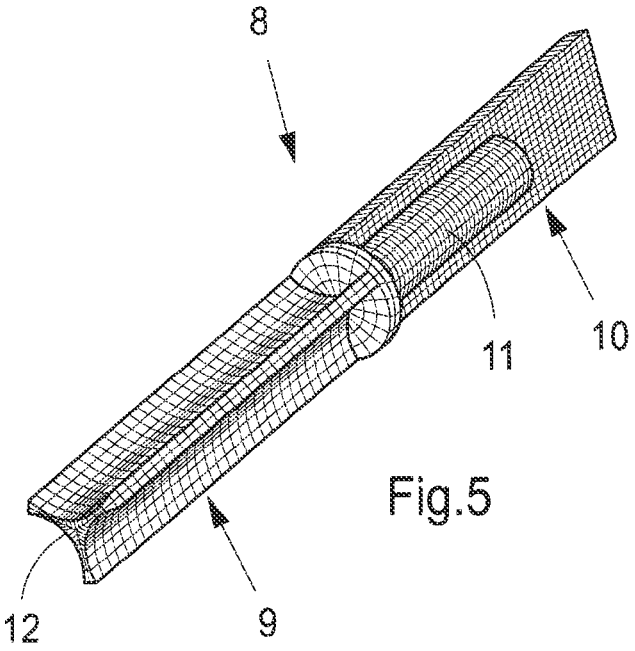
Figure 6:
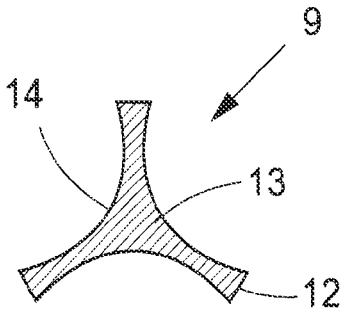
Figure 7:
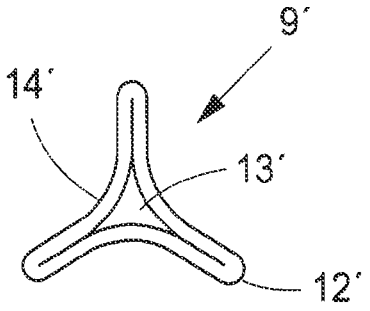

FIG. 5 shows schematically a side view of a penetrator, comprising a front penetrator part and a rear fin part, FIG. 6 shows schematically a cross section of a in part according to FIG. 5, FIG. 7 shows schematically a cross section of an alternative embodiment of a fin part according to FIG. 5.

DETAILED DESCRIPTION OF EMBODIMENTS

FIGS. 1 and 2 show a rotationally stable shell 1, comprising a rear part 2 and a shell casing 3 comprising a packing unit 6 of fin-stabilized penetrators 8, also referred to as projectiles. On the rear part 2 of the shell 1 there is disposed a band 4 for stabilizing the shell 1 as it is fired. The shell casing 3 preferably comprises three openable segments 5, FIG. 2, for opening of the shell casing 3 and release of the penetrators 8 in a combat situation. The segments 5 are articulately disposed in the rear part 2 of the shell 1 in order, when activated, to bend, outwards and rearwards in the longitudinal direction of the shell 1. The segments 5 are activated with the aid of an opening mechanism 7, disposed in the front part of the shell casing 3. Other opening devices for the shell casino 3 are possible. In an alternative embodiment (not shown), the shell casing 3 comprises an openable nose part instead of openable segments.

FIG. 1 shows the shell 1 prior to activation of the segments 3, and FIG. 2 shows it following activation. After the segments 5 have been activated and the shell casing 3 has opened, the rotational force of the shell 1 means that the penetrators 8 detach from the carrier shell 1 and separate from one another.

As can be seen from FIG. 5, the front part 10 of the penetrator 8 comprises some type of active component 11, for example an explosive charge, which active component 11 is activated in response to penetration of a ballistic shield, with or without time delay.

In an alternative embodiment (not shown), the front part 10 of the penetrators can also be constituted by a solid body, for example in hard metal, configured to penetrate a ballistic shield by kinetic action.

The front part 10 of the penetrator 8, FIG. 5, is tubular with circular cross section, but can also be configured with square or triangular cross section. The fin part 9 of the penetrator 8 constitutes a separate component and is fitted directly onto the front part 10 of the penetrator 8, preferably by screwing. The fin part 9 can also be fitted by gluing or by press fit.

In an alternative embodiment (not shown), the fin part 9 and the front penetrator part 10 are fitted on either side of an intermediate mounting part. The fin part 9 is preferably constituted by an oblong solid 13 moulded plastics body 9, 9', configured with triangular cross section, FIGS. 6 and 7. In order to obtain a higher strength, the plastic can advantageously be replaced by a composite or metallic material. In the special embodiment, FIG. 7, the fin part 9' is constituted by a metal casing which has been form-pressed, the interior of the fin part 9' being constituted by an empty space 13', which means a fin part 9' with lower weight.

Apart from stabilizing the penetrator during its flight phase, the fin part 9, 9' fulfils an important function as a packing device in connection with packing of the penetrators 8 into the shell casing 3. The penetrators 8 are packed in groups 7 of, preferably, four or five penetrators 8, FIG. 3, the groups being joined together to form a larger packing unit 6, the size and shape of which are matched to the size and shape of the shell casing 3, FIGS. 1 and 2.

Each packing group comprises a centrally located penetrator 8 flanked by at least three outer penetrators 8, the three flanking penetrators 8 being arranged such that their front penetrator parts 10 lie side to side against the fin sides 14, 14' of the centrally located penetrator 8.

In the preferred embodiment, FIG. 3, the fin sides 14, 14' are shaped concavely with a curvature corresponding to the shape of the front penetrator part 10, preferably a rotationally symmetrical shape with circular cross section, which allows effective dense packing of the penetrators 8.

FIG. 3 shows a cross section of a packing group 7 comprising four penetrators 8, three of the penetrators flanking the fin part 9 of the fourth, centrally located penetrator. The three penetrators 8 are thus distributed symmetrically around the fin part 9 of the fourth penetrator 8, which means that the empty space between the penetrators 8 can be reduced compared with if the penetrators 8 are packed side by side.

The packing method and the fact that the fin part 9 is shorter than the front penetrator part 10 cause the acceleration load upon firing of the carrier shell 1 to travel exclusively via the front penetration parts 10, whereby the fins 12 are totally relieved of load.

For fixing or attachment of the flanking penetrators 8 to the fin part 9 of the central penetrator 8, at least one fastening and/or fixing device (not shown) is disposed on suitable parts of the fin part 9, preferably on the concave outer sides 14, 14' of the fin part 9. Alternatively, the fastening device can be disposed in the rear part of the front part 10 of the penetrator 8, adjacent to the fin part 9, or on an intermediate mounting part (not shown).

The fastening device is preferably of the passive type and is constituted by one or more snap fastenings configured to be broken under the influence of the rotational force of the carrier shell 1 in connection with the opening of the carrier shell 1. The fastening device can also be constituted by a glue joint or by a press fit.

The fastening devices are thus dimensioned to be broken in response to the rotational force of the shell 1, so that the direction and speed of the penetrators 8 are not disturbed.

Alternatively, the fastening device can be of the active type, i.e. configured to break in response to an electrical activation signal from an internal control unit or in response to an activation signal from a ground-based transmitter. An example of an active fastening device is an electromagnetic device, for example a solenoid.

The invention is not limited to shown embodiments but can be varied in different ways within the scope of the patent claims. It will be appreciated, for example, that the number, size, material and shape of the elements and parts which belong to the shell and the penetrators and which are of importance to the invention, for example fin parts, active components and fastening devices, can be adapted with regard to one another and with regard to other integral elements or parts, and also with regard to the enemy target or targets which are intended to be attacked.

What is claimed is:

1. Carrier shell comprising fin-stabilized penetrators arranged therein wherein the fin-stabilized penetrators comprise a cylindrical front penetrator part and a rear fin part comprising fin sides, so that the empty space between the penetrators and problems with the penetrators upon the release of the penetrators from the carrier shell are minimized, wherein the penetrators are arranged in packing groups and are joined together to form larger packing units in which each packing group is arranged with a centrally located penetrator flanked by at least three outer penetrators, wherein the outer penetrators are arranged so that their front penetrator parts lie side to side against the fin sides of the centrally located penetrator, wherein the rear fin parts of the penetrators are shorter than the front penetrator parts of the penetrators, and the cylindrical front penetrator part has a flat front and a flat rear end such that the rear end of a first cylindrical penetrator part rests on the front end of a second cylindrical penetrator part for the distribution of load stresses rearwards, relative to the direction of firing of the carrier shell, from the centrally located penetrator via the front penetrator parts of the flanking penetrators, whereby the rear fin parts of the penetrators, upon the release of the penetrators from the carrier shell, are wholly relieved of load apart from the bottommost layer of penetrators closest to the rear part of the carrier shell, wherein the load is relieved via cylindrical front penetrator parts.

2. The carrier shell according to claim 1, wherein the rear fin parts are configured with a triangular cross section, corresponding to the tubular shape of the front penetrator part.

3. The carrier shell according claim 1, wherein the rear fin parts of the penetrators are arranged with fastenings for the attachment of flanking penetrators, wherein the fastenings are disposed on the rear parts of the penetrators and are constituted by one or more snap fastenings configured to be broken under the influence of the rotational force of carrier shell.

4. The carrier shell according to claim 1, wherein the rear fin parts of the penetrators are configured as separate components for fitting of the front parts of the penetrators by screws.

5. The carrier shell according to claim 2, wherein the rear fin parts are arranged with fastenings for the attachment of flanking penetrators.

6. The carrier shell according to claim 2, wherein the rear fin parts of the penetrators are configured as separate components for fitting of the front parts of the penetrators.

7. The carrier shell according to claim 3, wherein the rear fin parts of the penetrators are configured as separate components for fitting of the front parts of the penetrators.

* * * * *